US006683964B1

(12) United States Patent
Baumhauer, Jr. et al.

(10) Patent No.: US 6,683,964 B1
(45) Date of Patent: Jan. 27, 2004

(54) DIRECTION FINDER

(75) Inventors: John Charles Baumhauer, Jr., Indianapolis, IN (US); Jeffrey Phillip McAteer, Fishers, IN (US); Alan Dean Michel, Noblesville, IN (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 08/665,061

(22) Filed: May 15, 1996

Related U.S. Application Data

(63) Continuation-in-part of application No. 08/268,463, filed on Jun. 30, 1994, now abandoned.

(51) Int. Cl.[7] ..... H04R 3/00; H04R 1/40
(52) U.S. Cl. ..... 381/356; 381/355; 381/150
(58) Field of Search ..... 381/92, 91, 56, 381/150, 355, 356

(56) References Cited

U.S. PATENT DOCUMENTS 4,031,501 A * 6/1977 Caruso ..... 340/6 R
4,131,760 A 12/1978 Christensen et al. ..... 179/1 P
4,581,758 A * 4/1986 Coker et al. ..... 381/92
5,226,087 A * 7/1993 Ono et al. ..... 381/92
5,506,908 A * 4/1996 Baumhauer ..... 381/92

FOREIGN PATENT DOCUMENTS

EP 0690655 A2 * 3/1996 ..... H04R/1/40
JP 5[1993]-111020 4/1993 ..... H04N/7/15

OTHER PUBLICATIONS

"Digital Signal Processing With Adaptive Delay Elements", D. M. Etter, University of New Mexico, PhD Thesis, 1979.

* cited by examiner

*Primary Examiner*—Jerome Grant, II

(57) ABSTRACT

A direction finder arrangement advantageously employs a plurality of transducers to derive a plurality of predetermined polar directivity patterns each of which has a predetermined spatial orientation pointing in a predetermined fixed direction relative to each of the other polar directivity patterns. The polar directivity patterns detect a plurality of amplitude values of a propagating wave approaching at different angles relative to the plurality of spatially oriented polar directivity patterns. Then, the detected wave amplitude values are processed to determine an estimate of a direction toward the source of the arriving wave. More specifically, the detected amplitude values are processed to obtain an estimate of the directional orientation of a hypothetical polar directivity pattern pointing toward the source of the arriving wave.

14 Claims, 5 Drawing Sheets

*FIG. 3* MICROPHONE ELEMENT LAYOUT AND CORRESPONDING POLAR RESPONSE

DIRECTION FINDER

CROSS REFERENCE TO RELATED APPLICATIONS

This application is a continuation-in-part of U.S. patent application Ser. No. 08/268,463 filed Jun. 30, 1994, now abandoned U.S. patent applications Ser. No. 08/268,462, now U.S. Pat. No. 5,506,908 issued Apr. 9, 1996 and Ser. No. 08/268,464 now U.S. Pat. No. 5,515,445 issued May 7, 1996 were filed concurrently herewith.

TECHNICAL FIELD

This invention relates to microphone systems and, more particularly, to a direction finder employing microphones.

BACKGROUND OF THE INVENTION

The availability of powerful, low-cost digital signal processors (DSPs) and programmable adaptive algorithms are increasingly allowing communications terminals to adapt to their environmental, user and network variations. Directional microphones, by their nature, can help mitigate the corrupting influence of room noise and reverberation on the performance of speakerphone systems. However, if narrow audio polar directivity patterns, i.e., directional beams, are to be steered in a full room coverage situation, then the talker's location—often rapidly changing—must be known. Another need for a "talker direction finder" is in a multimedia communication or security product where a camera or display are directed. Yet another area of application for a talker direction finder might be to allow the near-end on a teleconference to identify which far-end participant is associated with the voice signal being received. In order to realize these applications, the talker (sound) direction finder would have to follow a rapidly moving talker (acoustic source), or switch to a new talker (acoustic source) readily and accurately, with full 360° coverage.

One known direction finder arrangement is described in a thesis authored by D. M. Etter entitled "Digital Signal Processing With Adaptive Delay Elements", University of New Mexico, PhD. Thesis, 1979, which uses an adaptive, minimization technique to realize the audio polar directivity pattern. This arrangement requires, for a desired directional resolution, increased processing power as the microphone elements are spaced closer together. Alternatively, large spacing between the microphone elements is not physically advantageous in many applications because it limits bandwidth and requires talkers to stay farther from the microphone elements in order to retain accuracy. In either case, resolution is greatest in a direction perpendicular to a line between microphone elements and is therefore not uniform. If the directional range of this arrangement is to be extended from 180° to 360°, two such arrangements are required. Additionally, the Etter arrangement requires phase information to be retained which would prohibit utilizing such techniques as a noise guard depending on long-term amplitude windowing or the like.

Another known arrangement is disclosed in U.S. Pat. No. 4,131,760 issued to Christensen and Coker on Dec. 26, 1978. The Christensen and Coker arrangement performs very well in many applications, particularly for large distances up to 50 feet away from the microphone elements. They describe 2.5 feet as a reasonable spacing between microphone elements to achieve a desirable resolution. Again, this relatively large spacing is to large for many applications, and leads to restrictions on how close a talker could approach the microphone elements without compromising accuracy. Greater amounts of signal processing could be used to circumvent these limitations. Again, the directional resolution of this arrangement is not uniform, and two such arrangements are required to realize 360° coverage.

SUMMARY OF THE INVENTION

Problems and limitations with prior direction finder arrangements are overcome by employing a plurality of transducers to derive a plurality of predetermined polar directivity patterns each of which has a predetermined spatial orientation and pointing in a predetermined fixed direction relative to each of the other polar directivity patterns. The polar directivity patterns detect a plurality of amplitude values of a propagating wave approaching at different angles relative to the plurality of spatially oriented polar directivity patterns. Then, the detected wave amplitude values are processed to determine an estimate of a direction toward the source of the arriving wave. More specifically, the detected amplitude values are processed to obtain an estimate of the directional orientation of a hypothetical polar directivity pattern pointing toward the source of the arriving wave.

A technical advantage of the invention is that low cost, small sized omni directional microphones can be employed in forming the polar directivity patterns and that the microphones may be placed very close to one another.

DETAILED DESCRIPTION

Figure 1:
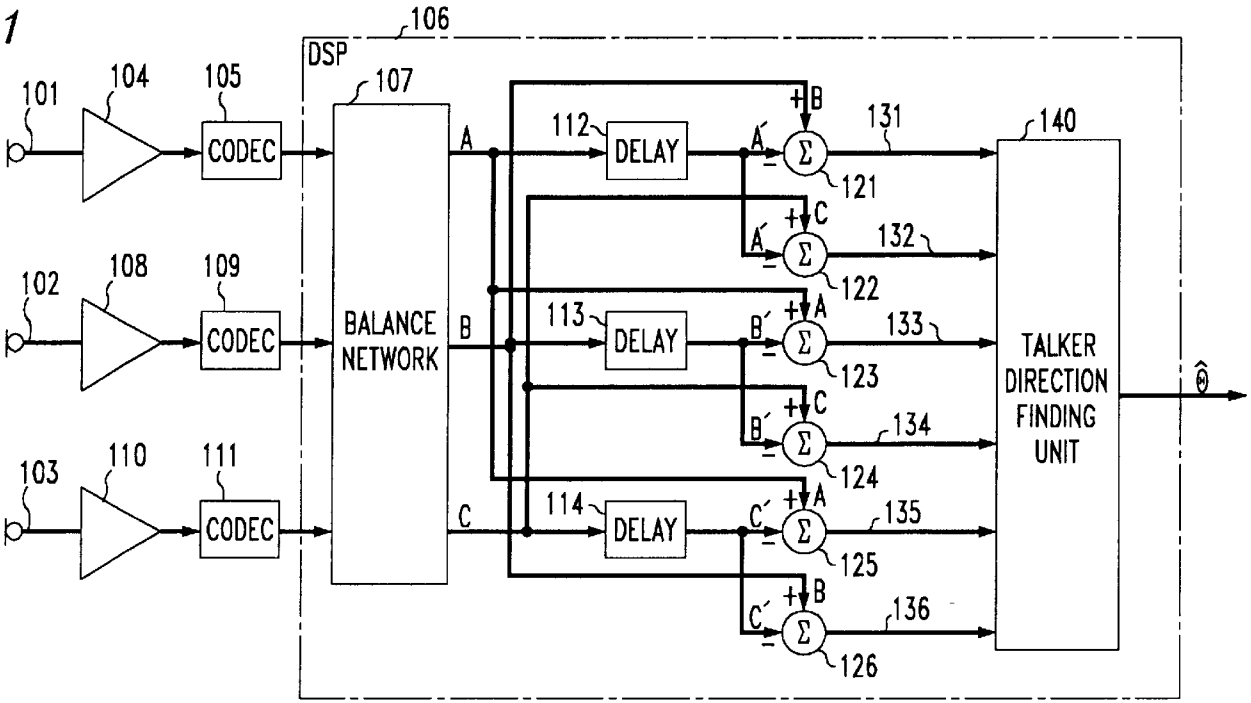
FIG. 1 is a signal flow diagram illustrating a direction finder system employing one embodiment of the invention.

FIG. 1 illustrates in simplified form a signal flow diagram for signal channels associated with three microphone elements employed in one embodiment of the invention. The signal flow diagram of FIG. 1 illustrates the signal flow processing algorithm which may be employed in a digital signal processor (DSP) to realize the invention. It is noted, however, although the preferred embodiment of the invention is to implement it on such a digital signal processor, that the invention may also be implemented as an integrated circuit or the like. Such digital signal processors are commercially available, for example, the DSP 1600 family of processors available from AT&T.

Figure 2:
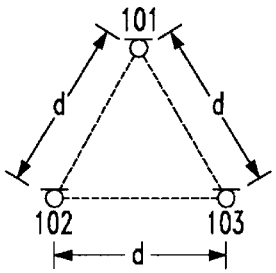
FIG. 2 shows the spatial relationship of the microphone elements employed in the embodiment of FIG. 1.

Shown in FIG. 1 are microphone elements 101, 102 and 103, which in this embodiment, are arranged in an equilateral triangle as shown in FIG. 2. As shown in FIG. 2, microphone elements 101, 102 and 103 are placed at the vertices of the equilateral triangle with a predetermined spacing "d" between the vertices. In this example, the spacing d between the vertices is approximately 0.85 inches.

Figure 4:
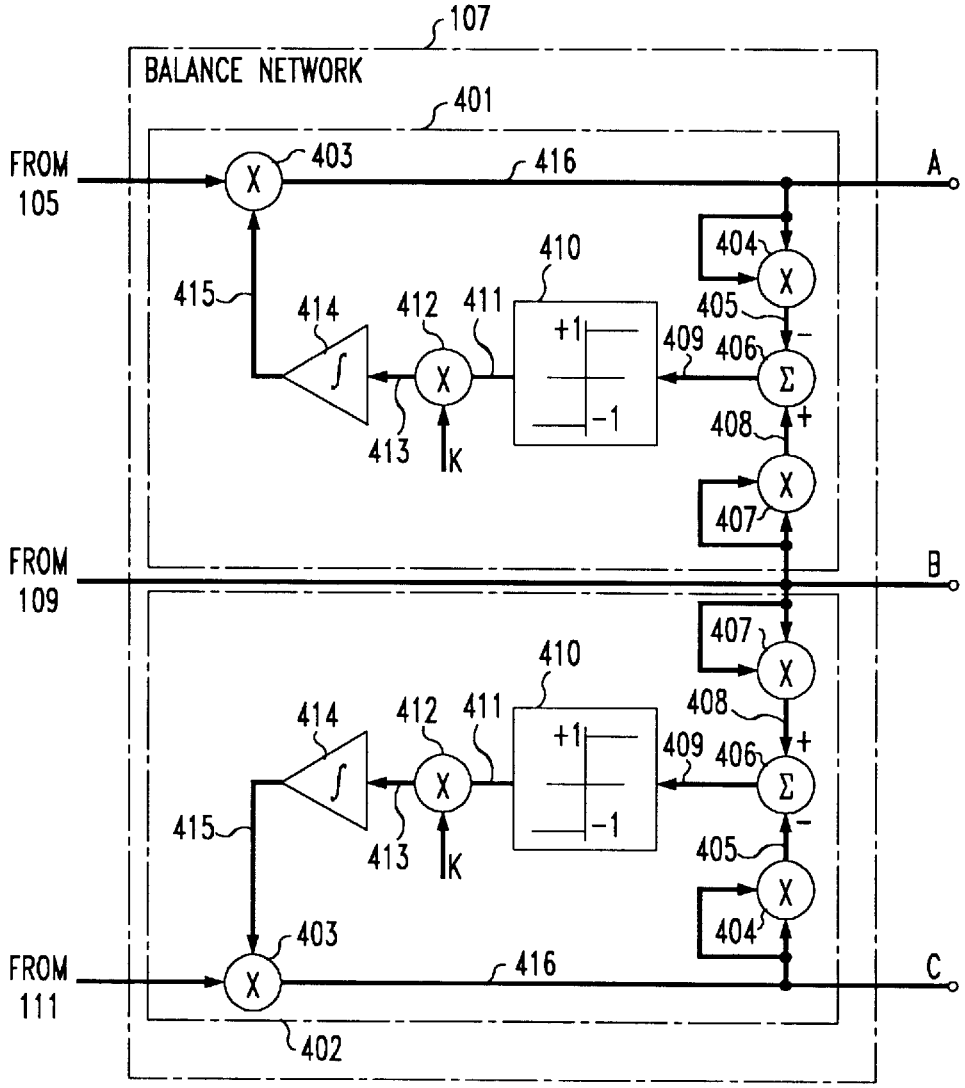
FIG. 4 shows a signal flow diagram for the balance network employed in the embodiments shown in FIG. 1.

An output signal from microphone element 101 is supplied via amplifier 104 and Codec 105 to DSP 106 and therein to balance network 107. DSP 106 includes the digital signal flow processing to realize the invention. Also shown is microphone element 102 whose output is supplied via amplifier 108 and Codec 109 to DSP 106 and therein to balance network 107. Finally, an output signal from microphone element 103 is supplied via amplifier 110 and Codec 111 to DSP 106 and therein to balance network 107. In one example, employing the invention, microphone elements 101, 102 and 103 are so-called omni-directional microphones of the well-know electret type. Although other types of microphone elements may be utilized the invention, it is the electret type that are the preferred ones because of their low cost. Codecs 105, 109 and 111 are also well known in the art. One example of a Codec that can advantageously be employed in the invention is the T7513B Codec, also commercially available from AT&T. In this example, the digital signal outputs from Codecs 105, 109 and 111 are encoded in the well-known mu-law PCM format, which in DSP 106 must be converted into a linear PCM format. This mu-law-to-linear PCM conversion is well known. Balance network 107 is employed to balance, i. e., match, the long term average broad band gain of the signal channels associated with microphone elements 101, 102 and 103 to one another. In this example, the long term average broad band gain of the signal channels associated with microphone elements 101 and 103 are balanced to the signal channel associated with microphone element 102. Details of balance network 107 are shown in FIG. 4 and described below.

More specifically, DSP 106 first forms a plurality of polar directivity patterns, i.e., directional beams, to provide full pick up coverage of a particular space, for example, a room, stage, arena, area or the like. In this example, the polar directivity patterns are acoustic (audio) and provide full 360° coverage of the particular space. To this end, the balanced microphone signal channel outputs A, B and C corresponding to microphones 101, 102 and 103, respectively, from balance network 107 are delayed by delay units 112, 113 and 114, respectively. In this example, each of delay units 112, 113 and 114 provides a time delay interval equivalent to the time that sound takes to travel the distance d from one of the microphone pick up locations to another to yield frequency independent time delayed versions A', B' and C', respectively. The delayed signal outputs A', B' and C' from delay units 112, 113 and 114 are then algebraically combined with the non-delayed versions A, B and C, respectively, from balance network 107 via algebraic summing units 121 through 126 to generate signals representing, in this example, cardioid polar directivity patterns.

Figure 3:
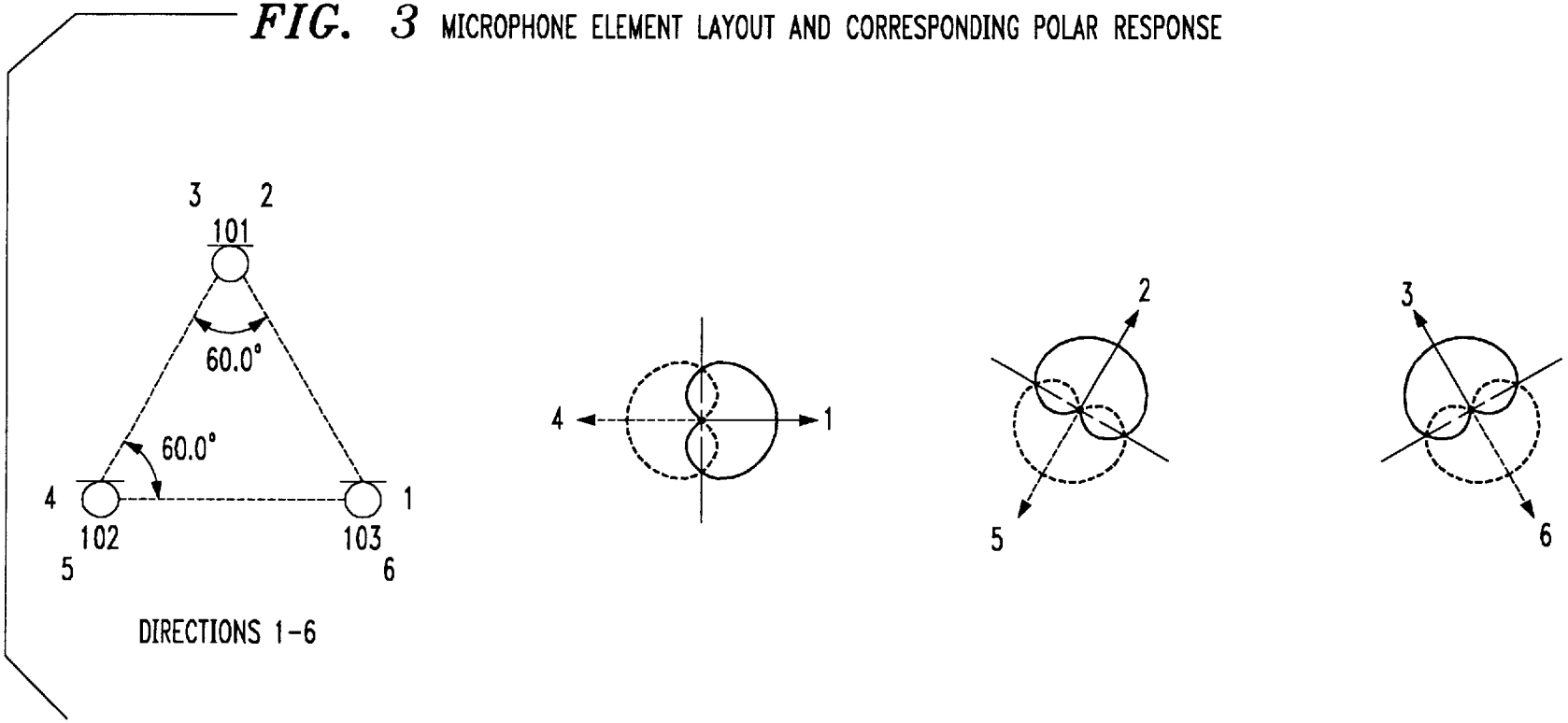
FIG. 3 shows polar directivity patterns for the configuration of microphone elements shown in FIG. 2 resulting from employing the embodiment of FIG. 1.

FIG. 3 illustrates the relationship of the equilateral triangle configuration of microphones 101, 102 and 103 and the resulting six cardioid polar directivity patterns are in predetermined spatial orientation to each other to provide full 360° pickup coverage. In this example, the six polar directivity patterns are pointing in fixed directions and are spaced 60° apart from each other to provide the full 360° coverage. The six cardioid polar directivity patterns result from the algebraic summing of the delayed versions of the balanced channel signals A', B' and C' with the non-delayed balanced channel signals A, B and C, respectively. Thus, summing unit 121 yields at circuit point 131 a signal (B-A') representative of a cardioid polar directivity pattern having its null in the direction of microphone 101 and having its maximum sensitivity in the direction of microphone 102 (shown in dashed outline in FIG. 3 from direction 2 to direction 5). Summing unit 122 provides at circuit point 132 a signal (C-A') representative of a cardioid polar directivity pattern having its null also in the direction of microphone 101 and having its maximum sensitivity in the direction of microphone 103 (shown in dashed outline in FIG. 3 from direction 3 to direction 6). Summing unit 123 yields at circuit point 133 a signal (A-B') representative of a cardioid polar directivity pattern having its null in the direction of microphone 102 and having its maximum sensitivity in the direction of microphone 101 (shown in solid outline in FIG. 3 from direction 5 to direction 2). Summing unit 124 yields at circuit point 134 a signal (C-B') representative of a cardioid polar directivity pattern having its null in the direction of microphone 102 and having its maximum sensitivity in the direction of microphone 103 (shown in solid outline in FIG. 3 from direction 4 to direction 1). Summing unit 125 yields at circuit point 135 a signal (A-C') representative of a cardioid polar directivity pattern having its null in the direction of microphone 103 and having its maximum sensitivity in the direction of microphone 101 (shown in solid outline in FIG. 3 from direction 6 to direction 3). Summing unit 126 yields at circuit point 136 a signal (B-C') representative of a cardioid polar directivity pattern having its null in the direction of microphone 103 and having its maximum sensitivity in the direction of microphone 102 (shown in dashed outline in FIG. 3 from direction 1 to direction 4). Consequently, in this example, six cardioid polar directivity patterns are obtained 60° apart from each other to provide the full 360° coverage of the particular space of interest. The signals at circuit points 131 through 136, representative of the cardioid polar directivity patterns, are supplied to talker direction finding unit 140. The purpose of the cardioid polar directivity patterns generated by summing units 121 through 126 is to pick up single acoustic sources, for example, single talkers.

Talker direction finding unit 140 is responsive to the output signals from summing units 121 through 126 representative of the predetermined cardioid polar directivity patterns to generate an estimated direction, $\hat{\Theta}$, representative of the direction of the source from which an arriving propagatingwave is emanating from, in this example, a talker. In general an estimate of the direction $\hat{\Theta}$ towards the source of the arriving wave can be obtained by generating error values between wave values on a hypothetical polar directivity pattern pointing toward the estimate of the direction of the source of the arriving wave and the detected values on j predetermined polar directivity patterns, namely, $\rho_i(\hat{\Theta})=y_i^N-g(\hat{\Theta}-\hat{\Theta}_i)$, where $y_i^N$ are the measured wave amplitude values in each frame for each of the j predetermined polar directivity patterns normalized to the largest of the measured wave amplitude values in a frame, i=0,1,2, . . . ,j−1, $g(\hat{\Theta})$ is a polar directivity pattern having a magnitude of unity for $\Theta=0$ and being symmetric with respect to $\pm\Theta$, and $\Theta_i$ is the direction of each of the j predetermined polar directivity patterns. Then, the total error is obtained by calculating $$H(\hat{\Theta}) = \sum_{i=0}^{j-1} \left\{ -2\rho_i(\hat{\Theta}) \left[ \frac{dg(\hat{\Theta}-\Theta_i)}{d\hat{\Theta}} \right] \right\}.$$

Figure 5:
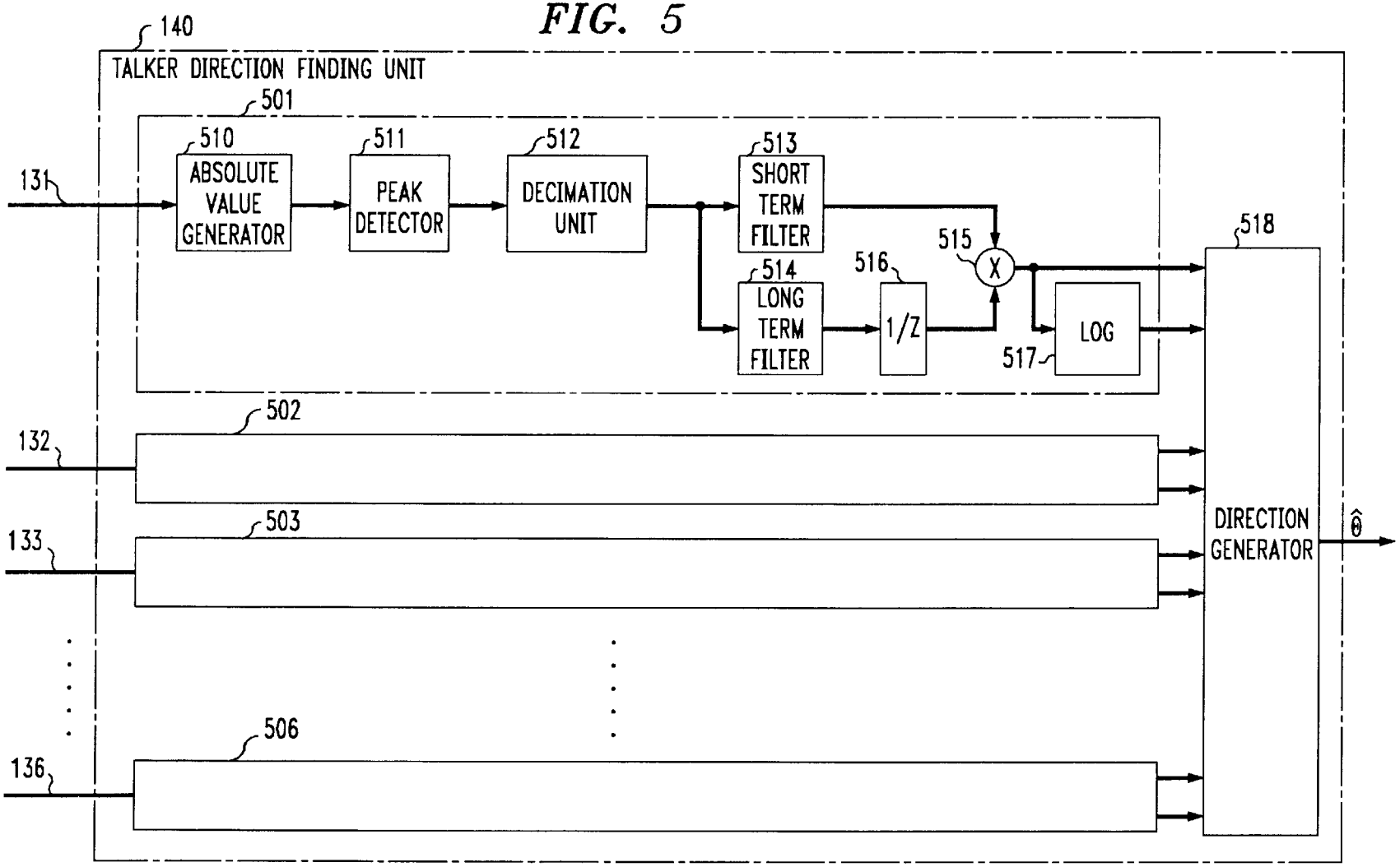
FIG. 5 shows in simplified form details of the talker direction finding unit employed in the embodiment of FIG. 1.
Figure 6:
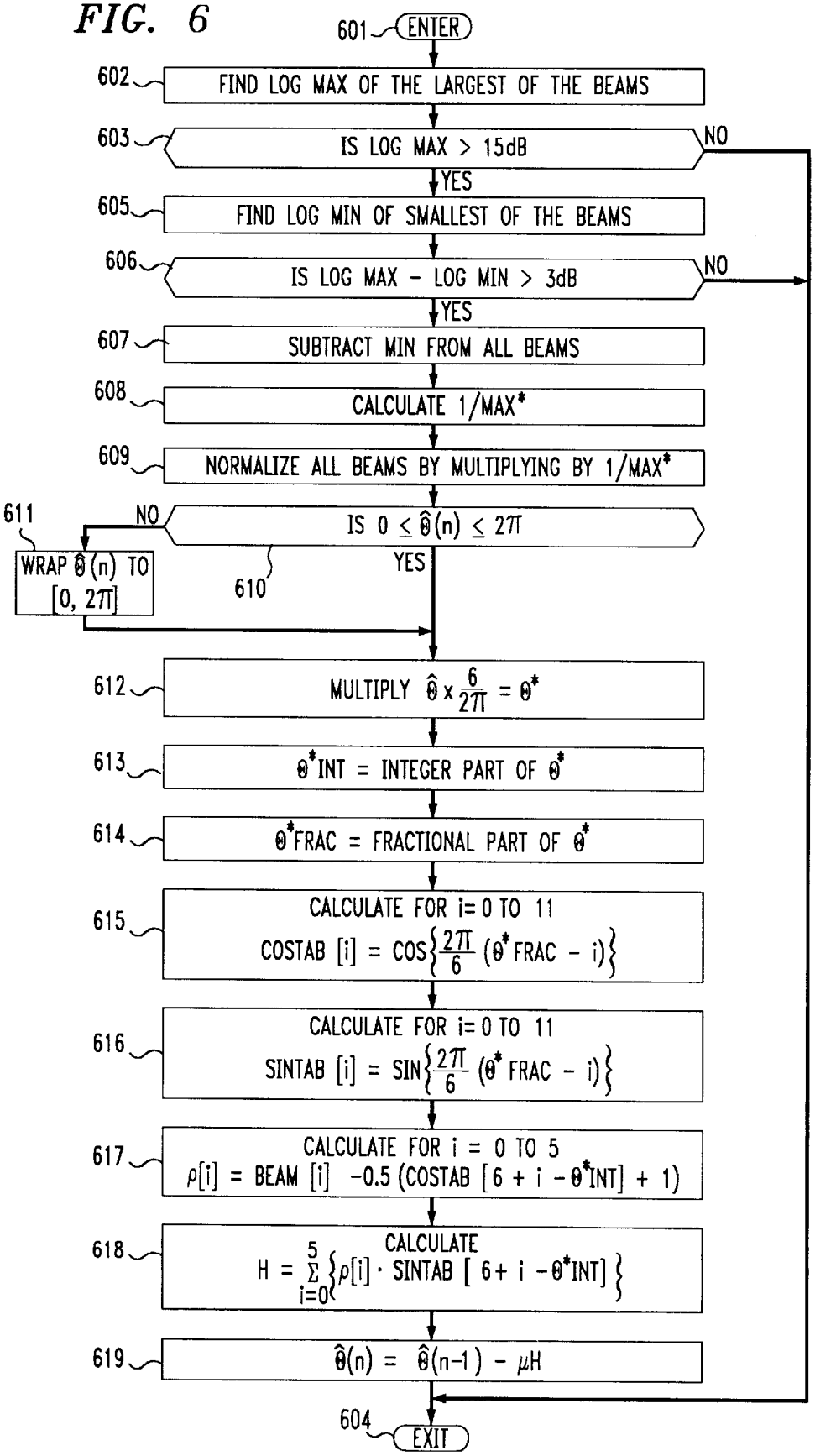
FIG. 6 is a flow chart illustrating the operative steps of the direction generator employed in the talker direction finding unit of FIG. 5.

Finally, a current estimate of the direction of the hypothetical polar directivity pattern pointing toward the wave source is calculated by $\hat{\Theta}(n)=\hat{\Theta}(n-1)-\mu H\hat{\Theta}$ where $\hat{\Theta}(n)$ is the estimated direction of the arriving wave source in a frame, $\mu$ is an arbitrary small constant and n is the frame time index and d indicates differentiation. In one example, the predetermined polar directivity patterns are first order gradient patterns where $$g(\Theta) = \frac{1 + B\cos(\Theta)}{1 + B},$$

where $$B \geq \frac{1}{2}$$

and in a specific example, B=1. Details of talker direction finder 140 for a specific embodiment are shown in FIGS. 5 and 6, which are described below.

FIG. 4 shows in simplified form a signal diagram illustrating the operation of balance network 107. The mu-law PCM output from each of Codecs 105, 109 and 111 is converted to linear PCM format (not shown) in DSP 106. Then, the linear PCM representations of the outputs from Codec 105 and Codec 111 are supplied to gain differential correction factor generation units 401 and 402, respectively. Because the long term average broad band gain of the microphone signal channels corresponding to microphones 101 and 103 are being matched to the signal channel of microphone 102, in this example, the linear PCM format output of Codec 109 does not need to be adjusted. Since each of gain differential correction factor generation units 401 and 402 is identical and operates the same, only gain differential correction factor generation unit 401 will be described in detail. To this end, the elements of each of gain differential correction factor generation units 401 and 402 have been labeled with identical numbers.

The matching, i.e., balancing, of the long term average broad band gain of the signal channels corresponding to microphone elements 101 and 102 is realized by balancing the signal channel level corresponding to microphone element 101 to that of microphone element 102. To this the linear PCM versions of the signals from Codecs 105 is supplied to multiplier 403. Multiplier 403 employs a gain differential correction factor 415 to adjust the gain of the linear PCM version of the signal from Codec 105 to obtain an adjusted output signal 416, i.e., A, for microphone 101. As indicated above, the linear PCM version of the signal from Codec 109 does not need to be adjusted and this signal is output B from balance network 107. The adjusted output C of balance network 107 is from gain differential correction factor generation unit 402.

The gain differential correction factor 415 is generated in the following manner: adjusted microphone output signal 416 is squared via multiplier 404 to generate an energy estimate value 405. Likewise, the linear PCM version of the output signal from Codec 109 is squared via multiplier 407 to generate energy estimate value 408. Energy estimate values 405 and 408 are algebraically subtracted from one another via algebraic summing unit 406, thereby obtaining a difference value 409. The sign of the difference value 409 is obtained using the signum function 410, in well known fashion, to obtain signal 411. Signal 411 will be either minus one (−1) or plus one (+1) indicating which microphone signal channel had the highest instantaneous energy. Minus one (−1) represents microphone 101, and plus one (+1) represents microphone 102. Multiplier 412 multiplies signal 411 by a constant K to yield signal 413 which is a scaled version of signal 411. In one example, not to be construed as limiting the scope of the invention, K typically would have a value of $10^{-5}$ for a 22.5 ks/s (kilosample per second) sampling rate. Integrator 414 integrates signal 413 to provide the current gain differential correction factor 415. The integration is simply the sum of all past values. In another example, constant K would have a value of $5\times10^{-6}$ for an 8 ks/s sampling rate. Value K is the so-called "slew" rate of integrator 130.

FIG. 5 shows, in simplified block diagram form, details of the talker direction finding unit 140. Specifically, shown are so-called talker signal-to-noise estimation units 501 through 506. It is noted that each of talker signal-to-noise ratio estimate units 501 through 506 are identical to each other. Consequently, only talker signal-to-noise ratio estimation unit 501 will be described in detail. A signal representative of the cardioid polar directivity pattern generated by summing unit 121 is supplied via 131 to talker signal-to-noise ratio estimation unit 501 and therein to absolute value generator unit 510. The absolute value of the signal supplied via 131 is obtained and is then applied to peak detector 511 in order to obtain its peak value over a predetermined window interval. In this example, the window interval is one frame of 64 samples or 8 ms. The obtained peak value is supplied to decimation unit 512 which obtains the generated peak value every 8 ms, in this example, clears the peak detector 511 and supplies the obtained peak value to short term filter 513 and long term filter 514. Filters 513 and 514 provide noise guarding of signals from stationary noise sources. Short term filter 513, in this example, is a non-linear first order low pass filter having a predetermined rise time constant, for example, of 8 ms and a fall time, for example, of 800 ms. The purpose of filter 513 is to generally follow the envelope of the detected wave form. Long term filter 514 is also a non-linear first order low pass filter having, in this example, a rise time of 8 seconds and a fall time of 80 ms. The purpose of filter 514 is to track the level of background interference. The filtered output signal from short term filter 513 is supplied to one input of multiplier 515 The filtered output signal Z from long term filter 514 is inverted by inverter unit 516 and supplied to another input of multiplier 515. Twenty times the logarithm of the output signal from multiplier 515 is obtained via logarithm (LOG) unit 517, and is supplied to direction generator 518. Moreover, the output noise from long term filter 514 is substituted via algebraic combining unit 519 from the output corrupted signal from short term filter 513 to form an estimate of the linear value of a noise guarded signal, and estimate of the linear values of the noise guarded signal is also supplied to direction generator 518. Similarly, the linear and logarithmic versions of the output signals from talker signal-to-noise estimation units 502 through 506 are also supplied to direction generator 518. The output signals from all of talker signal-to-noise estimation units 501 through 506 are employed in direction generator 518 to generate a current estimate Θ of the direction toward the source on an arriving wave, as described below.

FIG. 6 shows a flow chart of the operational steps performed by direction generator 518 (FIG. 5) in responding to the detected wave amplitude values from talker signal-to-noise ratio estimation units 501 through 506 in generating an estimate of the direction $\hat{\Theta}$ of the hypothetical polar directivity pattern toward the source of the arriving wave. Specifically, the routine is entered via 601. Thereafter, step 602 selects the logarithm of the largest of the directional beams (LOG MAX), i.e., the largest logarithm (LOG) value from talker signal-to-noise ratio estimation units 501 through 506 of FIG. 5 detected on the corresponding fixed polar directivity pattern. Step 603 tests to determine if LOG MAX>15 dB. If the test result in step 603 is NO the process is exited via 604 and updating of the current estimate of the direction $\hat{\Theta}$ is inhibited in the current frame and the current estimate is employed. This insures that there is an actual talker. If the test result in step 603 is YES step 605 selects the logarithm of the smallest of the directional beams (LOG MIN) i.e., the smallest logarithm (LOG) value from talker signal-to-noise ratio estimation units 501 through 506 of FIG. 5 detected on the corresponding fixed polar sensitivity pattern. Step 606 tests to determine if the difference between LOG MAX and LOG MIN is greater than 3 dB, i.e., LOG MAX−LOG MIN>3 dB. Again, if the test result in step 606 is NO the process is exited via step 604, updating of the current estimate of the direction $\hat{\Theta}$ is inhibited and the current estimate is employed. This insures that only one talker is being detected. If the test result in step 606 is YES, step 607 causes the linear value of the smallest of the directional beams, i.e., the minimum detected amplitude value from all of the predetermined polar directivity patterns of FIG. 3, to be subtracted from all of the detected amplitudes on the polar directivity patterns. Then, step 608 causes 1/MAX * to be calculated where MAX *=MAX−MIN, where MAX is the linear value of the largest amplitude detected for all of the predetermined polar directivity patterns and where MIN is the linear value for the smallest amplitude detected for all of the predetermined directivity patterns. Step 609 normalizes all of the directional beams by multiplying each of them by 1/MAX *, i.e., each of the amplitude values detected for all of the predetermined polar directivity patterns is multiplied by 1/MAX *. Step 610 tests to determine whether $0 \leqq \hat{\Theta} \leqq 2\pi$. If the test result in step 610 is NO, step 611 causes the value of $\hat{\Theta}$ to be wrapped to (0,2 π) and control is passed to step 612. This may be realized by adding or subtracting by 2 π until $\hat{\Theta}$ is within the desired range. If the test result in step 610 is YES, control is also passed to step 612 which causes $\hat{\Theta}$ to be multiplied by 6/(2 π) to yield Θ*, i.e., $\hat{\Theta} \times 6/(2\pi) = \Theta^*$. Step 613 obtains the integer part, Θ* INT, of Θ* . Step 614 obtains the fractional part, Θ*FRAC, of Θ*. Step 615 calculates for i =0 to 11

$$\cos TAB[i] = \cos\left\{\frac{2\pi}{6}(\Theta^* FRAC - i)\right\}.$$

These twelve values are being calculated to go around the six predetermined polar directivity patterns twice. Step 616 calculates for i=0 to 11

$$\sin TAB[i] = \sin\left\{\frac{2\pi}{6}(\Theta^* FRAC - i)\right\}.$$

Again, these twelve values are being calculated to go around the six predetermined polar directivity patterns twice. Step 617 calculates for i=0 to 5 error values ρ[i]=BEAM[i]−0.5 (cos TAB[6+i−Θ*INT]+1), where BEAM[i] is the wave amplitude value detected on the $i^{th}$ directional beam, i.e., on the $i^{th}$ predetermined polar directivity pattern. These error values are between the estimated values on the hypothetical polar directivity pattern pointing toward the source of the arriving wave and the actually detected values on, in this example, the six (6) predetermined polar directivity patterns, i.e., the 6 cardioids shown in FIG. 3. Then, step 618 calculates $$H = \sum_{i=0}^{5} \{\rho[i] \cdot \sin TAB[6 + i - \Theta^{*INT}]\},$$

which is a weighted version of the total error. Step 619 then generates the current estimate of the direction of the hypothetical polar directivity pattern that is pointing towards the source of the arriving wave $\hat{\Theta}(n)$, namely, $\hat{\Theta}(n)=\hat{\Theta}(n-1)-\mu H\hat{\Theta}$, where $\mu$ is an arbitrary small constant, one example being $\mu$=0.1, and n is a frame time index, in this example, 64 sample interval or 8 ms. This process is repeated for each frame.

Although the embodiment of the invention has been described in the context of picking up acoustic (audio) signals, it will be apparent to those skilled in the art that the invention can also be employed to pick up other energy sources; for example, those which radiate radio frequency waves, ultrasonic waves, or acoustic waves in liquids and solids or the like.

What is claimed:

1. A direction finder comprising:

a plurality of transducer means, each of said plurality of transducer means being in a predetermined spatial orientation relative to the others of said transducer means, for deriving a plurality of polar directivity patterns, each of said polar diredtivity patterns pointing in a predetermined direction relative to each of the other polar directivity patterns, said pluralitv of polar directivity patterns detecting a plurality of amplitude values of a propagating wave arriving at each of said plurality of transducers, the arriving wave being at different angles relative to each of said plurality of spatially oriented polar directivity patterns; and means for processing the plurality of detected wave amplitude values to determine a current estimate of the direction of the source of the arriving wave including means supplied with the plurality of detected wave amplitude values for determining an estimate of the directional orientation of a hypothetical polar directivity pattern which is an estimate a direction pointing toward a source of the arriving wave, means for orienting the hypothetical polar directivity pattern along a current estimate of the direction toward the source of the arriving wave, means for obtaining amplitude values of the hypothetical polar directivity pattern in the directions of each of the predetermined polar directivity patterns, means for obtaining a representation of a total error between the hypothetical amplitude values and the detected wave amplitude values and means for utilizing the total error for generating a new estimate of the source direction $\hat{\Theta}$ of the arriving wave source.

2. The invention as defined in claim 1 wherein the estimate of the direction $\hat{\Theta}$ towards the source of the arriving wave is obtained by generating $$\rho_i(\hat{\Theta}) = y_i^N - g(\hat{\Theta} - \Theta_i), \quad H(\hat{\Theta}) = \sum_{i=0}^{j-1} \left\{-2\rho_i(\hat{\hat{\Theta}})\left[\frac{[2]dg(\hat{\Theta} - \Theta_i)}{d\hat{\Theta}}\right]\right\}$$

and $\hat{\Theta}(n)=\hat{\Theta}(n-1)-\mu H\hat{\Theta}$ where $\hat{\Theta}(n)$ is the estimated direction of the arriving wave source in a frame, $\hat{\Theta}_i$ is the direction of each of the j predetermined polar directivity patterns, i=0,1,2, . . . ,j−, g(Θ) is a polar directivity pattern having a magnitude of unity for Θ=0 and being symmetric with respect to ±Θ, $y_i^N$ are the measured wave amplitude values in each frame for each of the j predetermined polar directivity patterns normalized to the largest of the measured wave amplitude values in a frame, $\mu$ is an arbitrary small constant and n is the frame time index and d indicates differentiation.

3. The invention as described in claim 2 wherein said means for processing further includes means for obtaining a long term amplitude envelope of said detected amplitude values, means for obtaining a short term amplitude envelope of said detected amplitude values and means for comparing the long term amplitude envelope and the short term amplitude envelope, means for utilizing the result of said comparing to detect whether the arriving propagating wave is a speech signal and means for inhibiting updating of the direction estimate when a speech signal is not being detected.

4. The invention as defined in claim 3 wherein said means for processing includes means for subtracting the smallest of said detected wave amplitude values from all of the detected wave amplitude values.

5. The invention as defined in claim 4 wherein the arriving propagating wave is being emanated from an acoustic source.

6. The invention as defined in claim 5 wherein said means for processing further includes means for comparing the largest detected wave amplitude value and the smallest detected wave amplitude value to determine if a single acoustic source of the arriving propagating wave is being observed, and wherein said means for inhibiting further inhibits updating of the direction estimate when it is determined that there is more than one talker.

7. The invention as defined in claim 2 wherein each of said polar directivity patter are first order gradient patterns where, $$g(\Theta) = \frac{1 + B\cos(\Theta)}{1 + B},$$

where $$B \geq \frac{1}{2}.$$

8. The invention as defined in claim 7 wherein each of said polar directivity patterns is a cardioid, wherein B=1.

9. The invention as defined in claim 8 wherein said plurality of predetermined polar directivity patterns includes at least three (3).

10. The invention as defined in claim 9 wherein said plurality of predetermined polar directivity patterns are equally spaced relative to one another over the range of direction of interest.

11. The invention as defined in claim 7 wherein said plurality of predetermined polar directivity patterns includes at least six (6).

12. The invention as defined in claim 11 wherein said plurality of polar directivity patterns are equally spaced over a range of directions of interest.

13. The invention as defined in claim 12 wherein said plurality of polar directivity patterns are spaced 60° apart from each other.

14. The invention as defined in claim 11 wherein said plurality of directional transducer means includes at least three (3) omni directional microphones being in predetermined spatial relationship to each other for generating at least six (6) predetermined polar directivity patterns.

* * * * *